US008256042B2

(12) United States Patent
Yul et al.

(10) Patent No.: US 8,256,042 B2
(45) Date of Patent: Sep. 4, 2012

(54) COLLAPSIBLE BED FRAME INCLUDING CROSS UNITS AND METHOD FOR CONSTRUCTING COLLAPSIBLE BED FRAME

(75) Inventors: Lee Pil Yul, Fujian (CN); Huang Changjiu, Fujian (CN); Ye Zhengyi, Fujian (CN)

(73) Assignee: North Pole Limited, Kowloon (HK)

( * ) Notice: Subject to any disclaimer, the term of this patent is extended or adjusted under 35 U.S.C. 154(b) by 676 days.

(21) Appl. No.: 12/420,317

(22) Filed: Apr. 8, 2009

(65) Prior Publication Data

US 2009/0249546 A1 Oct. 8, 2009

(30) Foreign Application Priority Data

Apr. 8, 2008 (CN) ..... 2008 2 0101906 U

(51) Int. Cl.
*A47C 19/14* (2006.01)

(52) U.S. Cl. ..... 5/174; 5/110; 5/114

(58) Field of Classification Search ..... 5/110, 111, 5/114–115, 175–177, 181–185, 411
See application file for complete search history.

(56) References Cited

U.S. PATENT DOCUMENTS

| | | | | |
|---|---|---|---|---|
| 540,042 | A | 5/1895 | Blomberg | |
| 998,761 | A | 7/1911 | Engstrand | |
| 1,151,495 | A * | 8/1915 | Menten | 5/122 |
| 4,384,379 | A | 5/1983 | Yamada | |
| 4,846,204 | A * | 7/1989 | Sok Kyu | 5/113 |
| 6,134,727 | A | 10/2000 | Hwang | |
| 6,564,402 | B1 * | 5/2003 | Lin | 5/115 |
| 6,581,223 | B1 * | 6/2003 | Wang | 5/174 |
| 6,618,879 | B1 * | 9/2003 | Wu | 5/111 |
| 6,711,761 | B2 | 3/2004 | Choi | |
| 6,966,084 | B2 | 11/2005 | Le Gette et al. | |
| 7,114,205 | B2 | 10/2006 | Choi | |
| 7,272,865 | B2 * | 9/2007 | Le Gette et al. | 5/129 |
| 7,698,756 | B1 * | 4/2010 | Chen | 5/113 |

(Continued)

FOREIGN PATENT DOCUMENTS

KR 20020046704 A 6/2002

(Continued)

OTHER PUBLICATIONS

International Search Report, dated Dec. 9, 2009, from the International Searching Authority for co-pending International Application No. PCT/IB2009/051474 (7 pages).

*Primary Examiner* — Robert G Santos
*Assistant Examiner* — Brittany Wilson
(74) *Attorney, Agent, or Firm* — Armstrong Teasdale LLP

(57) ABSTRACT

A collapsible bed frame includes a first cross unit including a first link member pivotally coupled to a second link member at a first pivot point, and a support unit operatively coupled to the first cross unit. The support unit includes a first slider that is slidably coupled to the first link member. A first support member has a first end that is pivotally coupled to the second link member and an opposing second end that is pivotally coupled to the first slider. A second slider is slidably coupled to the first support member. A second support member has a first end that is pivotally coupled to at least one of the second link member and a connector operatively coupled to the second link member, and an opposing second end that is pivotally coupled to the second slider.

20 Claims, 7 Drawing Sheets

U.S. PATENT DOCUMENTS

| | | | | |
|---|---|---|---|---|
| 7,757,314 | B2 * | 7/2010 | Yul et al. | 5/174 |
| 2003/0019033 | A1 * | 1/2003 | Choi | 5/114 |
| 2003/0172966 | A1 | 9/2003 | Dotterweich et al. | |
| 2004/0000009 | A1 * | 1/2004 | Choi | 5/174 |
| 2008/0000024 | A1 | 1/2008 | Peixin et al. | |
| 2009/0139026 | A1 * | 6/2009 | Chen | 5/111 |

FOREIGN PATENT DOCUMENTS

| | | | |
|---|---|---|---|
| KR | 20030062917 | A | 7/2003 |

* cited by examiner

COLLAPSIBLE BED FRAME INCLUDING CROSS UNITS AND METHOD FOR CONSTRUCTING COLLAPSIBLE BED FRAME

CROSS REFERENCE TO RELATED APPLICATIONS

This application claims the benefit of Chinese Patent Application No. 200820101906.2, which is hereby incorporated by reference in its entirety.

BACKGROUND OF THE INVENTION

The subject matter disclosed herein relates to a collapsible bed frame and, more particularly, to a collapsible bed frame including one or more cross units.

At least some conventional collapsible bed frames include a plurality of scissor frame assemblies. Each scissor frame assembly includes a first frame member pivotally coupled to a second frame member at a central pivot point. Frame members of adjacent scissor frame assemblies are pivotally coupled to each other at a corresponding upper connector assembly and/or a corresponding lower connector assembly. The collapsible bed frame may further include a telescoping member coupled between an upper connector assembly and a corresponding lower connector assembly. The telescoping member is configured to move between a first or contracted configuration and a second or extended configuration to facilitate moving the collapsible bed frame between an expanded configuration and a collapsed configuration. With the bed frame in the expanded configuration, each telescoping member provides support at one of the four corners of the bed frame. However, such telescoping members may be costly to manufacture and incorporate into the collapsible bed frame.

BRIEF DESCRIPTION OF THE INVENTION

In one aspect, a collapsible bed frame is provided. The collapsible bed frame includes a first cross unit including a first link member that is pivotally coupled to a second link member at a first pivot point. A support unit is operatively coupled to the first cross unit. The support unit includes a first slider that is slidably coupled to the first link member. A first support member has a first end that is pivotally coupled to the second link member and an opposing second end that is pivotally coupled to the first slider. A second slider is slidably coupled to the first support member. A second support member has a first end that is pivotally coupled to at least one of the second link member and a connector operatively coupled to the second link member, and an opposing second end that is pivotally coupled to the second slider.

In another aspect, a cross unit for a collapsible bed frame is provided. The cross unit includes a first link member and a second link member pivotally coupled to the first link member at a first pivot point. A support unit is operatively coupled to the cross unit. The support unit includes a first slider slidably coupled to the first link member. A first support member has a first end that is pivotally coupled to the second link member and an opposing second end that is pivotally coupled to the first slider. A second slider is slidably coupled to the first support member. A second support member has a first end that is pivotally coupled to the second link member and an opposing second end that is pivotally coupled to the second slider.

In yet another aspect, a method is provided for constructing a collapsible frame. The method includes pivotally coupling a plurality of collapsible cross units together. Each cross unit of the plurality of cross units includes a first link member pivotally coupled to a second link member at a first pivot point. A support unit is operatively coupled to at least one cross unit of the plurality of cross units.

DETAILED DESCRIPTION OF THE INVENTION

Figure 1:
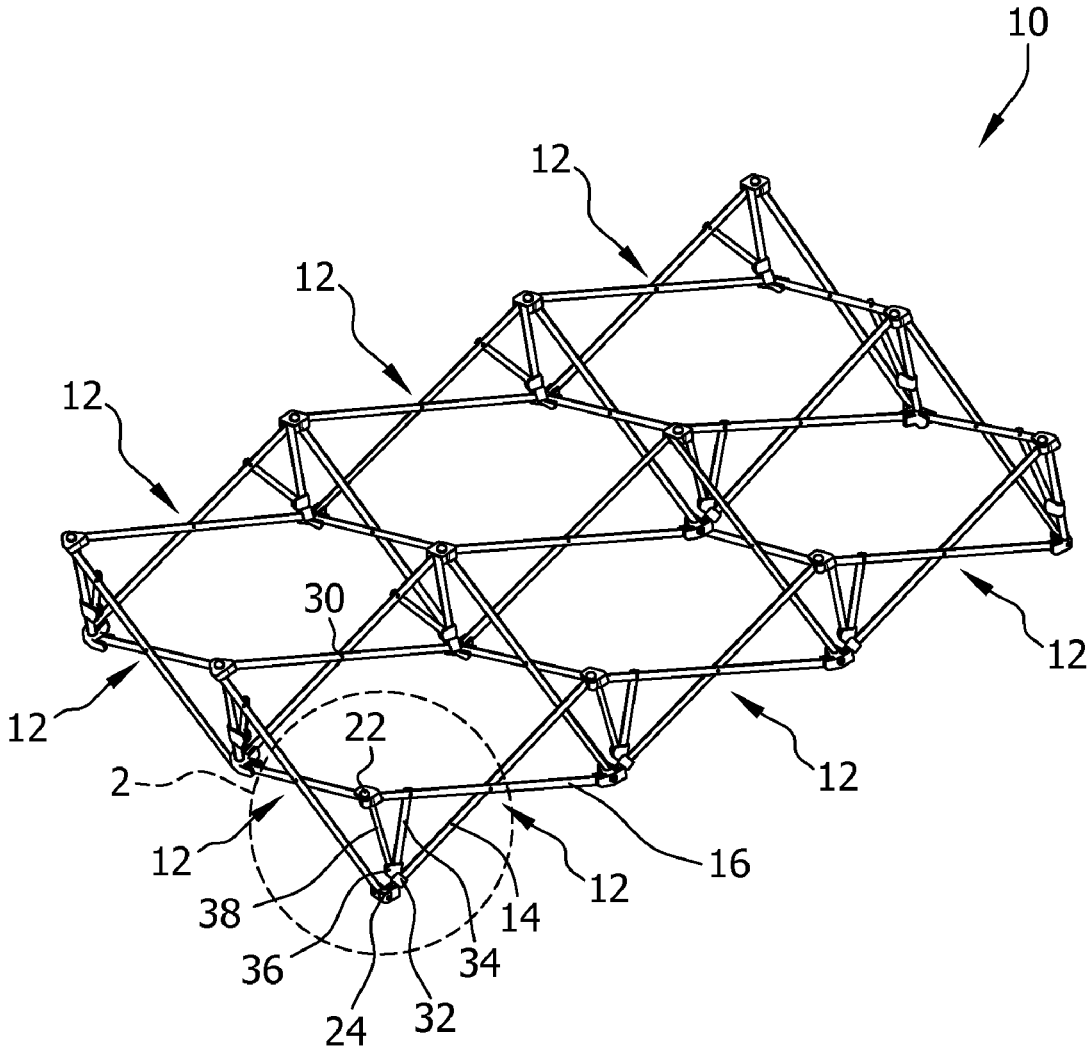
FIG. 1 is a perspective view of an exemplary collapsible bed frame in an expanded configuration.

The embodiments described herein provide a collapsible bed frame that is movable between an open or expanded configuration and a closed or collapsed configuration. The collapsible bed frame includes a plurality of foldable or collapsible cross units. Each cross unit includes a first link member pivotally coupled to a second link member. With the collapsible bed frame in the expanded configuration, each cross unit forms an X-shaped cross unit. Adjacent cross units are pivotally coupled to each other at upper and lower ends.

Further, a support unit is operatively coupled to or integrated with at least one cross unit. The support unit includes two support members and two sliders. A first slider is slidably coupled to or about the first link member. A first support member has a first end pivotally coupled to the second link member and an opposing second end pivotally coupled to the first slider. A second slider is slidably coupled to or about the first support member. A second support member has a first end pivotally coupled to the second link member and/or pivotally coupled to a connector operatively coupled to the second link member. An opposing second end of the second support member is pivotally coupled to the second slider.

In one embodiment, the collapsible bed frame includes a plurality of cross units and one or more support units each operatively coupled to a respective cross unit. The support unit facilitates expanding and collapsing the respective cross unit to facilitate expanding and collapsing the collapsible bed frame. Because the cross units and the support units are integrated into an interconnected structure in one embodiment, the collapsible bed frame is easy to expand and collapse. Further, with the collapsible bed frame in the expanded configuration, the support members of the support unit provide strength and stability to the respective X-shaped cross unit such that the collapsible bed frame is strong and stable and suitable for supporting one or more users.

The embodiments are described below in connection with a collapsible bed frame. However, it should be apparent to those skilled in the art that the embodiments described herein may likewise be applicable to any suitable collapsible frame including, without limitation, a collapsible chair frame or any suitable furniture frame.

The embodiments described herein provide a collapsible bed frame including a plurality of foldable or collapsible X-shaped cross units. Each cross unit includes a first link member and a second link member. Adjacent cross units are pivotally coupled to each other at an upper end and a lower end. In one embodiment, the adjacent cross units are pivotally coupled to each other at the upper end with an upper connector and at the lower end with a lower connector. A support unit is operatively coupled to at least one cross unit. The support unit includes a first slider slidably coupled to or about the first link member. For example, in one embodiment, the first slider is slidably coupled about a lower portion of the first link member between a respective connector and a middle pivot point of the cross unit. A first support member has a first end pivotally coupled to the second link member and an opposing second end pivotally coupled to the first slider. The support unit also includes a second slider slidably coupled to or about the first support member and a second support member having a first end pivotally coupled at a pivot point to the second link member and/or to a connector to which the second link member is pivotally coupled. An opposing second end of the second support member is pivotally coupled to the second slider.

In one embodiment, a distance between the pivot point at which the second support member is pivotally coupled to the second link member, and/or the connector, and a middle pivot point of the cross unit is greater than a distance between a pivot point at which the first support member is pivotally coupled to the second link member and the middle pivot point of the cross unit. For example, the first support member is pivotally coupled to an upper portion of the second link member of the cross unit and the second support member is pivotally coupled to a top end of the second link member or pivotally coupled to the connector to which the second link member is pivotally coupled.

The embodiments described herein provide a foldable or collapsible cross unit that includes a first link member pivotally coupled to a second link member. In one embodiment, the cross unit includes a support unit configured therewith, which includes a first slider slidably coupled to or about the first link member, a first support member having a first end pivotally coupled to the second link member and an opposing second end pivotally coupled to the first slider, a second slider slidably coupled to the first support member, and a second support member having a first end pivotally coupled to the second link member and/or pivotally coupled to a connector operatively coupled to the second link member and an opposing second end pivotally coupled to the second slider.

In one embodiment, a distance between a pivot point at which the second support member is pivotally coupled to the second link member and a middle pivot point of the cross unit is greater than a distance between a pivot point at which the first support member is pivotally coupled to the second link member and the middle pivot point of the cross unit. For example, the first support member has a first end that is pivotally coupled to an upper portion of the second link member of the cross unit and a first end of the second support member is pivotally coupled to a top end of the second link member and/or pivotally coupled to the connector to which the second link member is pivotally coupled.

Figure 2:
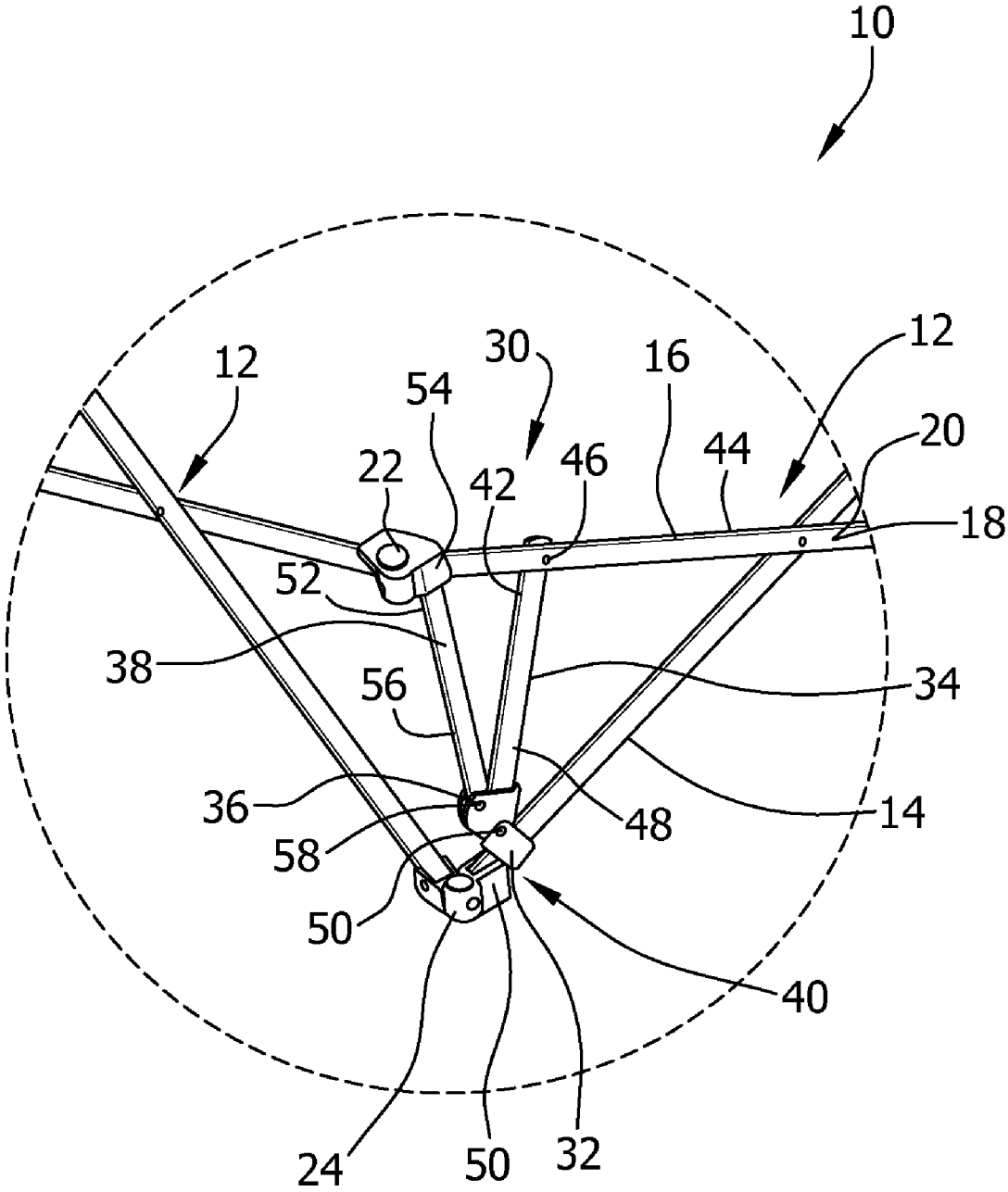
FIG. 2 is an enlarged view showing a portion of the collapsible bed frame shown in FIG. 1.

Referring to FIGS. 1-6, in one embodiment a collapsible bed frame 10 has any suitable number, such as seventeen, pivotally movable X-shaped cross units 12. Each cross unit 12 includes a first link member 14 pivotally coupled to a second link member 16. In a particular embodiment, a suitable fastener 18, such as a pin or rivet, pivotally couples first link member 14 to second link member 16 at a central or middle pivot point 20 of first link member 14 and second link member 16, as shown in FIG. 2, to form cross unit 12. Adjacent cross units 12 are pivotally coupled to each other at respective upper ends with an upper connector 22 and pivotally coupled to each other at respective lower ends with a lower connector 24 to form collapsible bed frame 10 having a shape with three longitudinal lines and four transverse lines as shown in FIG. 1, which are integrated into an interconnected structure.

Referring further to FIGS. 1-6, collapsible bed frame 10 includes one or more support units 30 configured to provide additional support for cross units 12. For example, in one embodiment a corresponding support unit 30 is coupled to or formed with each cross unit 12 positioned at a periphery of collapsible bed frame 10 and/or at any suitable position within collapsible bed frame 10, as desired, to provide necessary or additional support. In a particular embodiment, each cross unit 12 includes a corresponding support unit 30 configured therewith.

Referring again to FIGS. 2, 4, and 6, support unit 30 includes a first slider 32, a first support member 34, a second slider 36, and a second support member 38. First slider 32 is slidably couple to or about first link member 14 and is configured to move along a length of first link member 14 between a lower end 40 of first link member 14 coupled to lower connector 24 and middle pivot point 20 of first link member 14. First support member 34 has an upper end 42 pivotally coupled to an upper portion 44 of second link member 16 at a pivot point 46 and a lower end 48 pivotally coupled to first slider 32 at a pivot point 50. Second slider 36 is slidably coupled to or about first support member 34. Second support member 38 has an upper end 52 pivotally coupled to second link member 16 and/or upper connector 22 to which second link member 16 is pivotally coupled at a pivot point 54, and a lower end 56 pivotally coupled to second slider 36 at a pivot point 58 such that as second slider 36 moves along at least a portion of the length of first support member 34, second support member 38 pivots with respect to second link member 16 and/or upper connector 22 at upper end 52.

Figure 3:
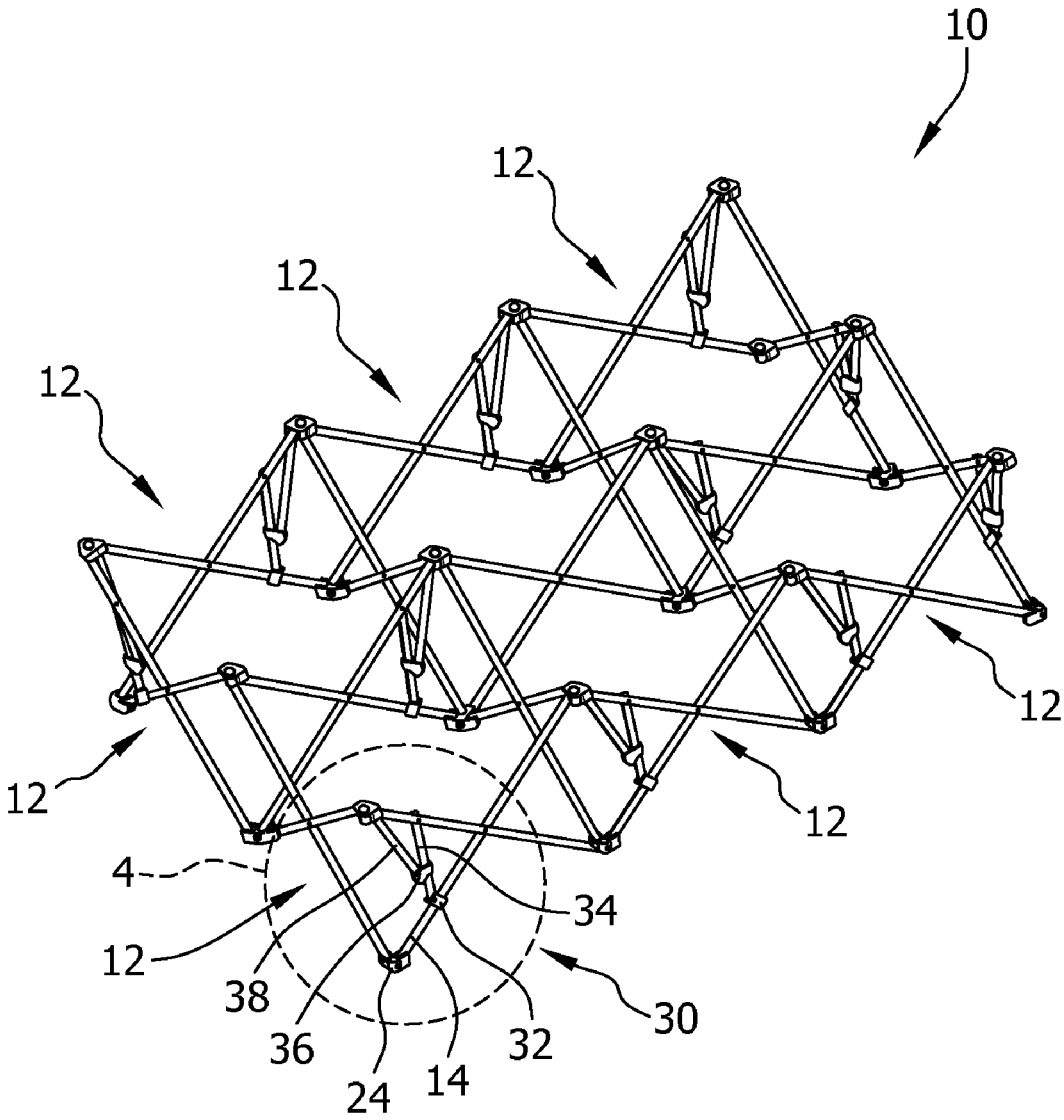
FIG. 3 is a perspective view of the collapsible bed frame shown in FIG. 1 in a partially collapsed configuration.
Figure 4:
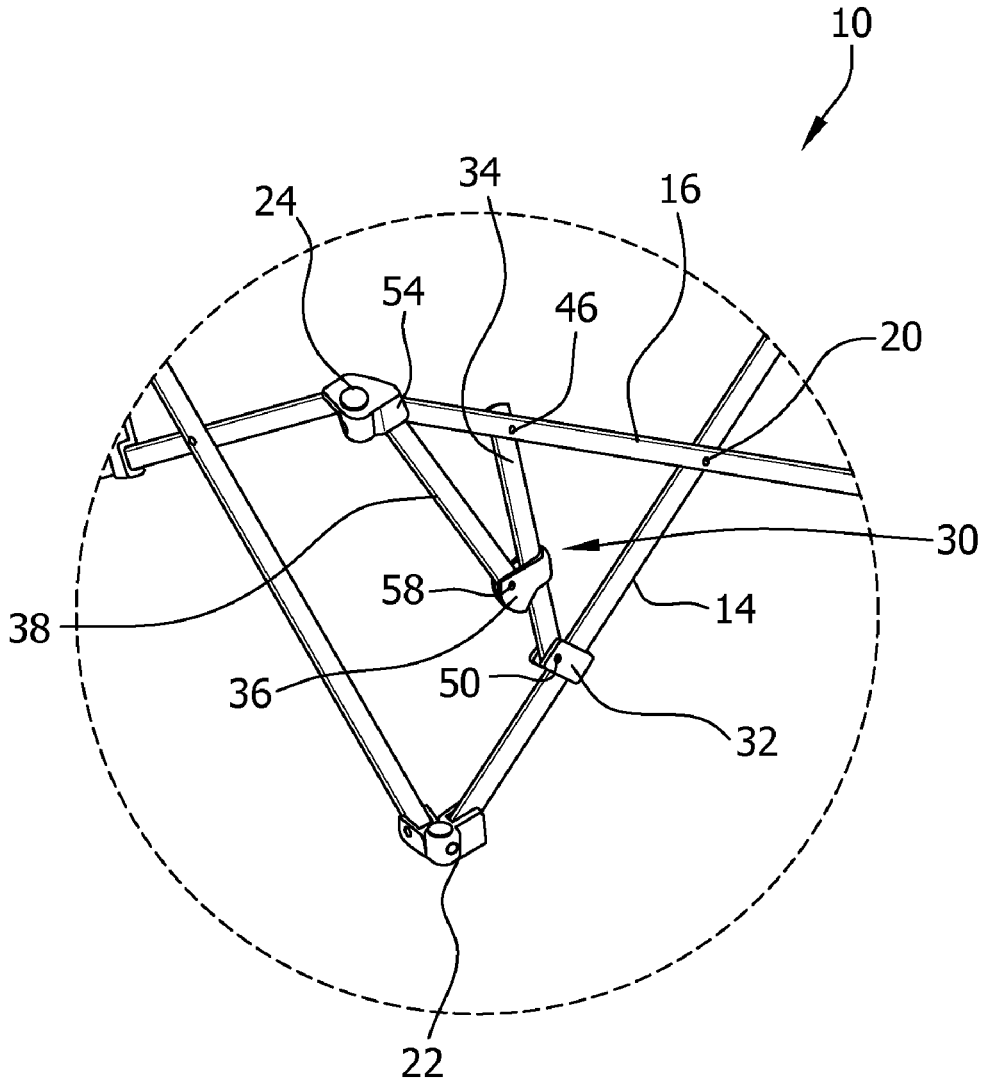
FIG. 4 is an enlarged view showing a portion of the collapsible bed frame shown in FIG. 3.
Figure 5:
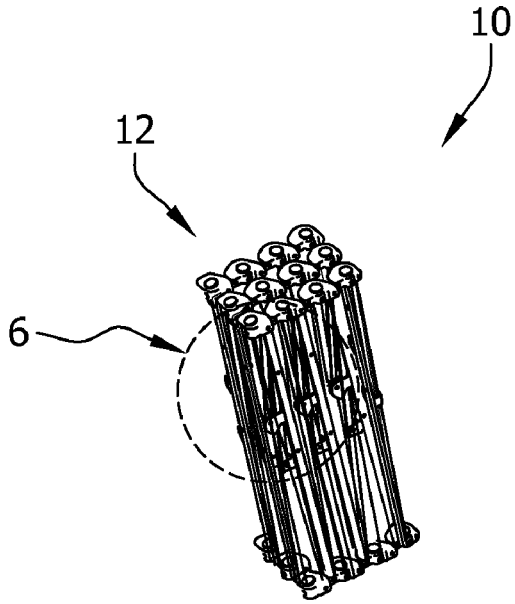
FIG. 5 is a perspective view of the collapsible bed frame shown in FIG. 1 in a collapsed configuration.
Figure 6:
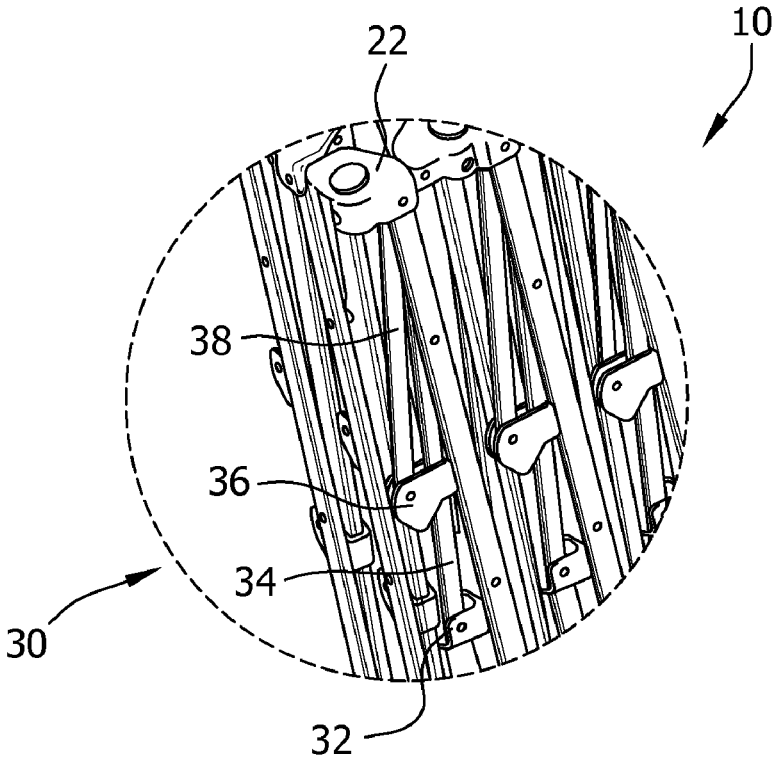
FIG. 6 is an enlarged view showing a portion of the collapsible bed frame shown in FIG. 5.

With collapsible bed frame 10 in an expanded configuration as shown in FIGS. 1 and 2, first slider 32 is seated against and/or contacts lower connector 24 and second slider 36 is seated against and/or contacts first slider 32 such that first support member 34 and second support member 38 provide suitable support for collapsible bed frame 10 between upper connector 22 and corresponding lower connector 24. As collapsible bed frame 10 is moved from the expanded configuration, shown in FIGS. 1 and 2, to a folded or collapsed configuration, shown in FIGS. 5 and 6, first slider 32 moves along at least a portion of the length of first link member 14 and away from lower connector 24 as shown in FIGS. 3 and 4. As first slider 32 moves along first link member 14, second slider 36 moves along at least a portion of a length of first support member 34 towards second link member 16 to facilitate moving collapsible bed frame 10 to the folded or collapsed configuration.

Figure 7:
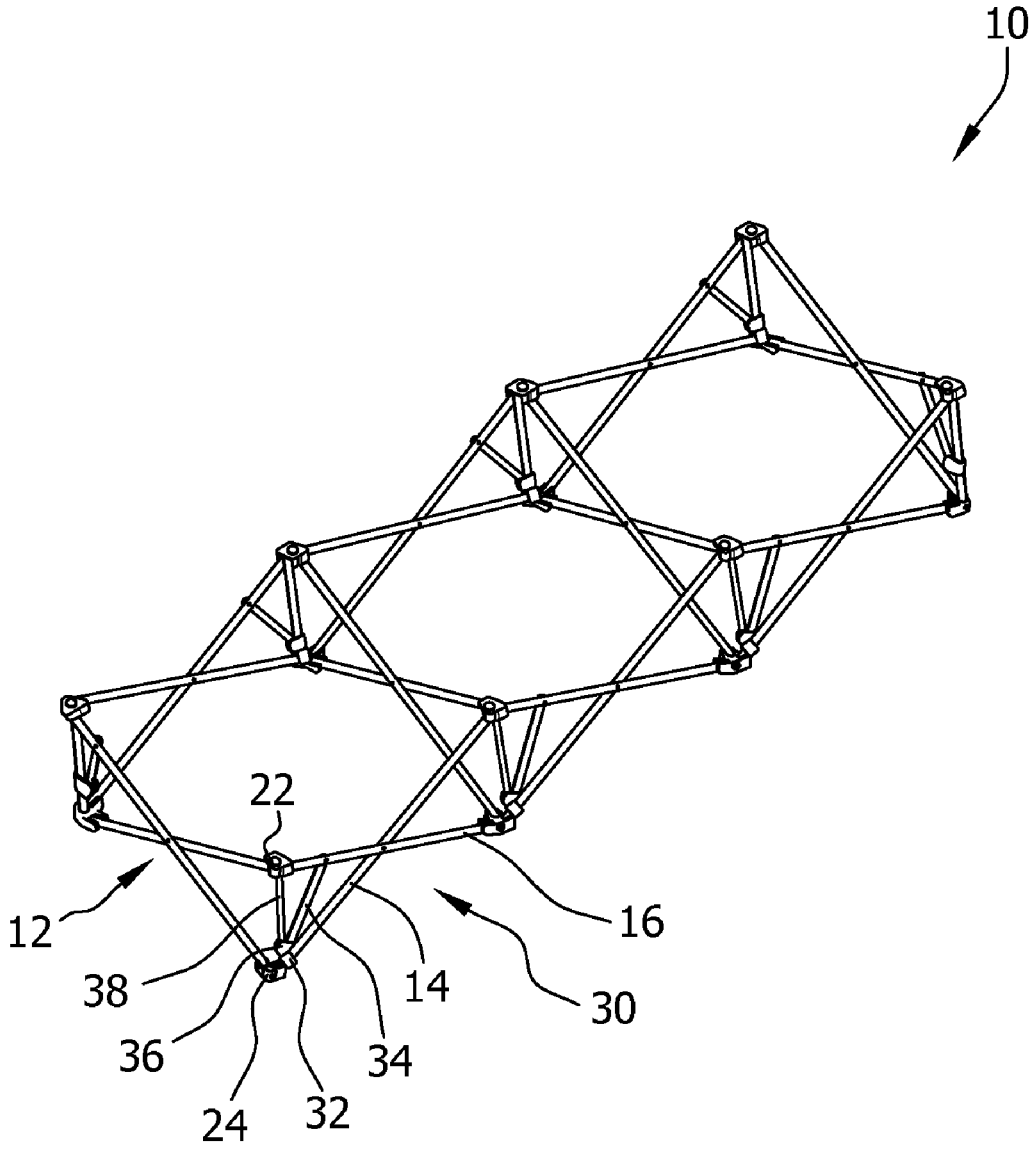
FIG. 7 is a perspective view of an alternative exemplary collapsible bed frame in an expanded configuration.

FIG. 7 is a perspective view of an alternative exemplary collapsible bed frame 10 in an expanded configuration. As shown in FIG. 7, collapsible bed frame 10 includes ten foldable X-shaped cross units 12. Each cross unit 12 has an upper end pivotally coupled to adjacent cross units 12 with a respective upper connector 22 and a lower end pivotally coupled to adjacent cross units 12 with a respective lower connector 24 to form collapsible bed frame 10 having a shape with two longitudinal lines and four transverse lines, which are integrated into an interconnected structure.

Figure 8:
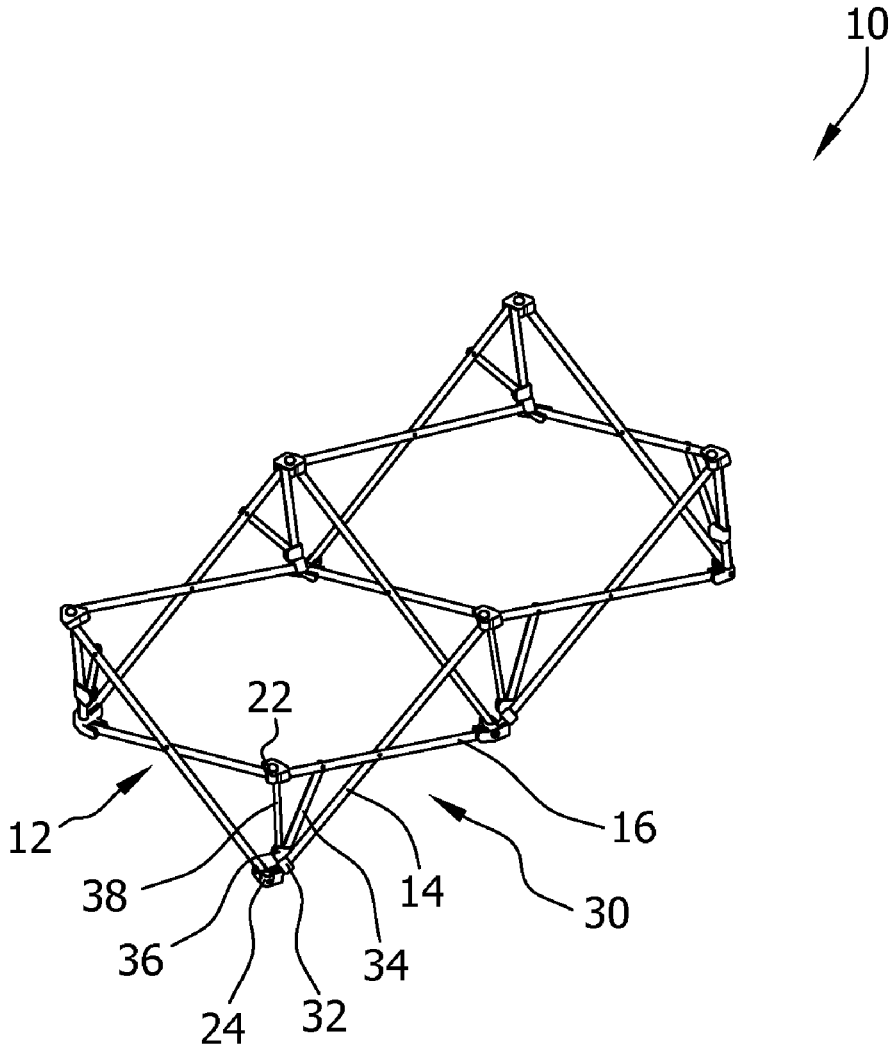
FIG. 8 is a perspective view of an alternative exemplary collapsible bed frame in an expanded configuration.

FIG. 8 is a perspective view of an alternative exemplary collapsible bed frame 10 in an expanded configuration. As shown in FIG. 8, collapsible bed frame 10 includes seven foldable X-shaped cross units 12. Each cross unit 12 has an upper end pivotally coupled to adjacent cross units 12 with a respective upper connector 22 and a lower end pivotally coupled to adjacent cross units 12 with a respective lower connector 24 to form collapsible bed frame 10 having a shape having two longitudinal lines and three transverse lines which are integrated into an interconnected structure.

In one embodiment, a method for constructing a collapsible frame includes pivotally coupling a plurality of collapsible cross units together. Each cross unit includes a first link member pivotally coupled to a second link member at a first pivot point. In one embodiment, the plurality of collapsible cross units are pivotally coupled together by pivotally coupling a first link member of a first cross unit and a second link member of an adjacent second cross unit to an upper connector, and pivotally coupling a second link member of the first cross unit and a first link member of the adjacent second cross unit to a lower connector.

A support unit is operatively coupled to at least one cross unit. In a particular embodiment, a support unit is operatively coupled to each collapsible cross unit. A first slider of the support unit is slidably coupled to the first link member. A first end of a first support member is pivotally coupled to the second link member and an opposing second end of the first support member is pivotally coupled to the first slider. The support unit also includes a second slider that is slidably coupled to the first support member. A first end of a second support member is pivotally coupled to the second link member and an opposing second end of the second support member is pivotally coupled to the second slider. In a particular embodiment, the first end of the second support member is pivotally coupled to a connector, such as an upper connector, to which the second link member is pivotally coupled. In a particular embodiment, the second support member is pivotally coupled at a second pivot point to the second link member and the first support member is pivotally coupled at a third pivot point to the second link member such that a first distance between the second pivot point and the first pivot point is greater than a second distance between the third pivot point and the first pivot point.

The embodiments described herein provide a collapsible bed frame including a plurality of pivotally movable cross units that can be efficiently and economically fabricated and incorporated into the collapsible bed frame, while improving the strength and durability of the collapsible bed frame to increase a useful life of the collapsible bed frame and facilitate the convenient operation of the collapsible bed frame. Because the embodiments described herein do not include telescoping members, the fabrication and/or assembly cost of the collapsible bed frame is reduced.

Exemplary embodiments of a collapsible bed frame including cross units and a method for constructing a collapsible frame are described above in detail. The collapsible bed frame and the method are not limited to the specific embodiments described herein, but rather, components of the collapsible bed frame and/or steps of the method may be utilized independently and separately from other components and/or steps described herein. Further, the described frame components and/or method steps can also be defined in, or used in combination with, other frames or assemblies and/or methods, and are not limited to practice with only the collapsible bed frame and the method as described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A collapsible bed frame comprising:

a first cross unit including a first link member pivotally coupled to a second link member at a first pivot point; and a support unit operatively coupled to the first cross unit, the support unit comprising:

a first slider slidably coupled to the first link member;

a first support member having a first end pivotally coupled to the second link member and an opposing second end pivotally coupled to the first slider;

a second slider slidably coupled to the first support member; and a second support member having a first end pivotally coupled to at least one of the second link member and a connector operatively coupled to the second link member, and an opposing second end pivotally coupled to the second slider.

2. The collapsible bed frame in accordance with claim 1 further comprising an adjacent cross unit operatively coupled to the first cross unit, the adjacent cross unit having a first link member pivotally coupled to a second link member.

3. The collapsible bed frame in accordance with claim 2 further comprising a second support unit operatively coupled to the adjacent cross unit.

4. The collapsible bed frame in accordance with claim 2 further comprising:

an upper connector pivotally coupling the first link member of the first cross unit to the second link member of the adjacent cross unit; and a lower connector pivotally coupling the second link member of the first cross unit to the first link member of the adjacent cross unit.

5. The collapsible bed frame in accordance with claim 4 wherein the upper connector pivotally couples a first end of the first link member of the first cross unit to a first end of a second link member of the adjacent cross unit, and the lower connector pivotally couples a first end of the second link member of the first cross unit to a first end of the first link member of the adjacent cross unit.

6. The collapsible bed frame in accordance with claim 1 wherein a first distance between a second pivot point at which the second support member is pivotally coupled to at least one of the second link member and the connector and the first pivot point is greater than a distance between a third pivot point at which the first support member is pivotally coupled to the second link member and the first pivot point.

7. The collapsible bed frame in accordance with claim 6 wherein the first support member is pivotally coupled to an upper portion of the second link member and the second support member is pivotally coupled to at least one of a top end of the second link member and the connector.

8. The collapsible bed frame in accordance with claim 7 wherein the second support member is pivotally coupled to the connector.

9. The collapsible bed frame in accordance with claim 1 wherein the first slider is slidably coupled to a lower portion of the first link member between a lower connector and the first pivot point.

10. The collapsible bed frame in accordance with claim 1 further comprising a plurality of first cross units, each first cross unit of the plurality of first cross units including a first link member pivotally coupled to a second link member at the first pivot point, and a support unit operatively coupled to each first cross unit.

11. The collapsible bed frame in accordance with claim 1 wherein, with the collapsible bed frame in an expanded configuration, the first cross unit forms an X-shaped first cross unit.

12. A cross unit for a collapsible bed frame, the cross unit comprising:

a first link member;

a second link member pivotally coupled to the first link member at a first pivot point; and a support unit comprising:

a first slider slidably coupled to the first link member;

a first support member having a first end pivotally coupled to the second link member and an opposing second end pivotally coupled to the first slider;

a second slider slidably coupled to the first support member; and a second support member having a first end pivotally coupled to the second link member and an opposing second end pivotally coupled to the second slider.

13. The cross unit in accordance with claim 12 further comprising a connector, the first end of the second support member pivotally coupled to the connector.

14. The cross unit in accordance with claim 12 wherein a first distance between a second pivot point at which the second support member is pivotally coupled to the second link member and the first pivot point is greater than a second distance between a third pivot point at which the first support member is pivotally coupled to the second link member and the first pivot point.

15. The cross unit in accordance with claim 14 wherein the first support member is pivotally coupled to an upper portion of the second link member and the second support member is pivotally coupled to a top end of the second link member.

16. The cross unit in accordance with claim 14 further comprising a connector, the second support member pivotally coupled at the second pivot point to the connector.

17. A method for constructing a collapsible frame, said method comprising:

pivotally coupling a plurality of collapsible cross units together, each cross unit of the plurality of cross units including a first link member pivotally coupled to a second link member at a first pivot point; and operatively coupling a support unit to at least one cross unit of the plurality of cross units, said operatively coupling comprising:

slidably coupling a first slider of the support unit to the first link member;

pivotally coupling a first end of a first support member to the second link member and an opposing second end of the first support member to the first slider;

slidably coupling a second slider to the first support member; and pivotally coupling a first end of a second support member to the second link member and an opposing second end of the second support member to the second slider.

18. The method in accordance with claim 17 wherein pivotally coupling a first end of a second support member to the second link member comprises pivotally coupling the first end of the second support member to a connector to which the second link member is pivotally coupled.

19. The method in accordance with claim 17 wherein pivotally coupling a plurality of collapsible cross units together comprises:

pivotally coupling the first link member of a first cross unit and the second link member of an adjacent second cross unit to an upper connector; and pivotally coupling the second link member of the first cross unit and the first link member of the adjacent second cross unit to a lower connector.

20. The method in accordance with claim 19 wherein the second support member is pivotally coupled at a second pivot point to the second link member and the first support member is pivotally coupled at a third pivot point to the second link member, a first distance between the second pivot point and the first pivot point is greater than a second distance between the third pivot point and the first pivot point.

* * * * *